US006287242B1

(12) United States Patent
Fray

(10) Patent No.: US 6,287,242 B1
(45) Date of Patent: Sep. 11, 2001

(54) ATHLETIC TRAINER

(76) Inventor: Alex R. Fray, P.O. Box 1211, Gonzalez, FL (US) 32560

( * ) Notice: Subject to any disclaimer, the term of this patent is extended or adjusted under 35 U.S.C. 154(b) by 0 days.

(21) Appl. No.: 09/429,474

(22) Filed: Oct. 29, 1999

(51) Int. Cl.[7] ..... A63B 21/00
(52) U.S. Cl. ..... 482/121; 482/124; 482/126
(58) Field of Search ..... 482/139, 121–130; D21/662; 2/68, 69, 79

(56) References Cited

U.S. PATENT DOCUMENTS 1,618,273 * 2/1927 Davidson ..... 482/124
1,663,641 3/1928 Smallwood .
4,911,439 3/1990 Kuhl .
4,993,705 2/1991 Tölle .
5,306,222 * 4/1994 Wilkinson ..... 482/124
5,336,139 * 8/1994 Miller ..... 482/124

* cited by examiner

*Primary Examiner*—Jerome W. Donnelly
(74) *Attorney, Agent, or Firm*—George A. Bode; Bode & Associates

(57) ABSTRACT

An athletic trainer is designed to exercise a wide variety of muscle groups and has a skirt that fits onto the shoulders of a user and a wrap that encompasses the user's torso section. A pair of elastic cords are connected between the skirt and the wrap on the front of the device, while another pair of elastic cords are attached to the back portion of the skirt and are coupled to the wrap at each cord's medial portion. Gloves are attached to each end of the this pair of elastic cords. Yet another pair of elastic cords are attached to the back portion of the skirt and are coupled to the wrap at each cord's medial portion. Straps are connected to each of this pair of elastic cords for coupling the cords to the footwear of the user.

11 Claims, 4 Drawing Sheets

ATHLETIC TRAINER

BACKGROUND OF THE INVENTION

1. Field of the Invention

The present invention relates to an athletic trainer that is worn by a user and that utilizes a system of elastic cords to allow exercising of a wide variety of muscle groups.

2. Background of the Prior Art

The desire to stay healthy has resulted in an explosion of devices designed to exercise various parts of the human body. These devices range from the highly effective to the bizarre. One item that has been recognized for human exercise is the elastic cord. The elastic cord is attached to one part of the body and to another part of the body (or to a fixed structure) and as the affected muscles pull on the elastic cord, the resistance of the cord causes the muscle or muscles to be exercised.

Many devices have been proposed that utilize the elastic cord to achieve the exercising function. These devices take on many shapes, sizes, and functions. Current devices found in the art have varying degrees of utility and effectiveness, however, no current device is designed to exercise a large variety of muscle groups in a system that is of relatively simple design and construction and that is relatively easy to transport.

Therefore, there is a need in the art for an athletic trainer that is relatively simple in design and construction, is relatively simple to use, and that affects a relatively large number of muscle groups of the human body.

SUMMARY OF THE INVENTION

The athletic trainer of the present invention addresses the aforementioned needs in the art. The athletic trainer is a relatively simple device that is worn by the user, is easy to put on and take off, and is easy to transport. The design of the athletic trainer allows a user to exercise most major muscle groups throughout the body as the user sees fit.

The athletic trainer is comprised of a skirt (that may have sleeves) that is worn on the user's shoulders. The skirt can be slipped over the user's head, or can have an opening that can be closed by any standard means such as by snaps, buttons, cooperating hook and loop material, etc. Ideally, the skirt will be made from a relatively strong material such as thick cotton, polyester, or leather, and may have an absorbent layer for absorbing the sweat from a user. A wrap is designed to be worn around the user's torso area. The wrap is similar in design and construction to a typical weight lifting belt and has appropriate closure means such as hook and loop material to close and size the wrap around the torso. The wrap is made from any appropriate material such as cotton, polyester, and leather, and may have a padded portion for user comfort and/or a reinforced portion to protect the user's back. A first elastic cord and a second elastic cord each extend between the skirt and the wrap. A third elastic cord and a fourth cord elastic each have one end attached to the skirt, a first medial portion that is coupled to the wrap, and an opposing end and each can have a glove attached to the second end. The medial portions of the third elastic cord and the fourth elastic cord can each be coupled to the wrap in any appropriate manner such as by providing a ring on the wrap and passing the respective cord through the respective ring or by having at least one aperture on the wrap and passing the respective cord through each of the respective at least one aperture. Grommets can encompass each aperture to prevent tearing of the wrap. A fifth elastic cord and a sixth elastic cord each have one end attached to the skirt, a medial portion that is coupled to the wrap, and an opposing end and each can have a strap attached to the respective cord, the strap being used to couple the elastic cord to the footwear of the user. The medial portions of the fifth elastic cord and the sixth elastic cord can be coupled to the wrap in any appropriate manner such as by providing a ring on the wrap and passing the respective cord through the respective ring or by having at least one aperture on the wrap and passing the respective cord through the respective at least one aperture. Grommets can encompass each aperture to prevent tearing of the wrap. A loop portion can be located on the end of the fifth elastic cord and the sixth elastic cord, each loop being held in a user's hand or can be used to couple the respective cord to the respective glove.

BRIEF DESCRIPTION OF THE DRAWINGS

Similar reference numerals refer to similar parts throughout the several views of the drawings.

DESCRIPTION OF THE PREFERRED EMBODIMENT

Figure 1:
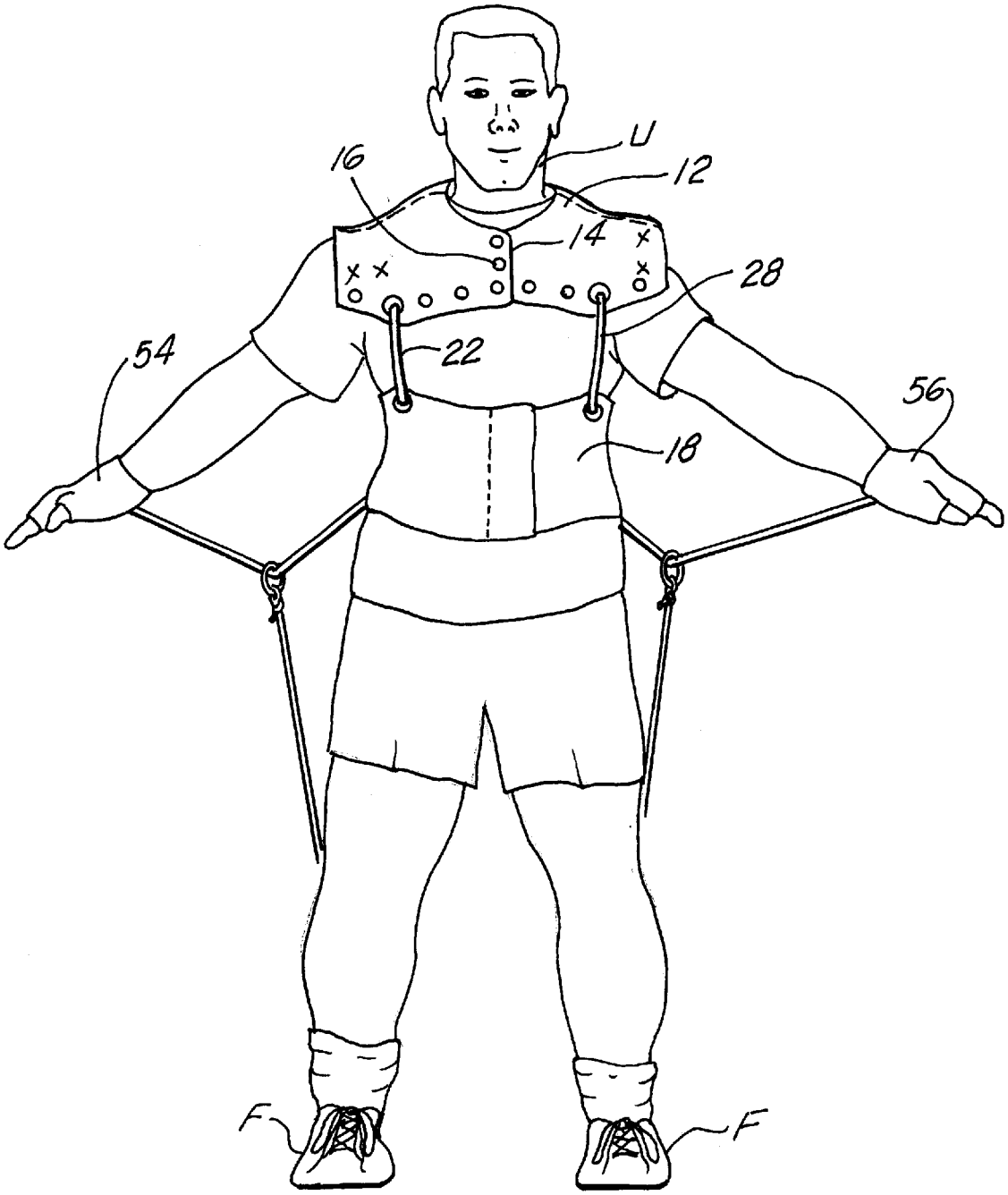
FIG. 1 is a front perspective view of the athletic trainer of the present invention being worn by a user.
Figure 2:
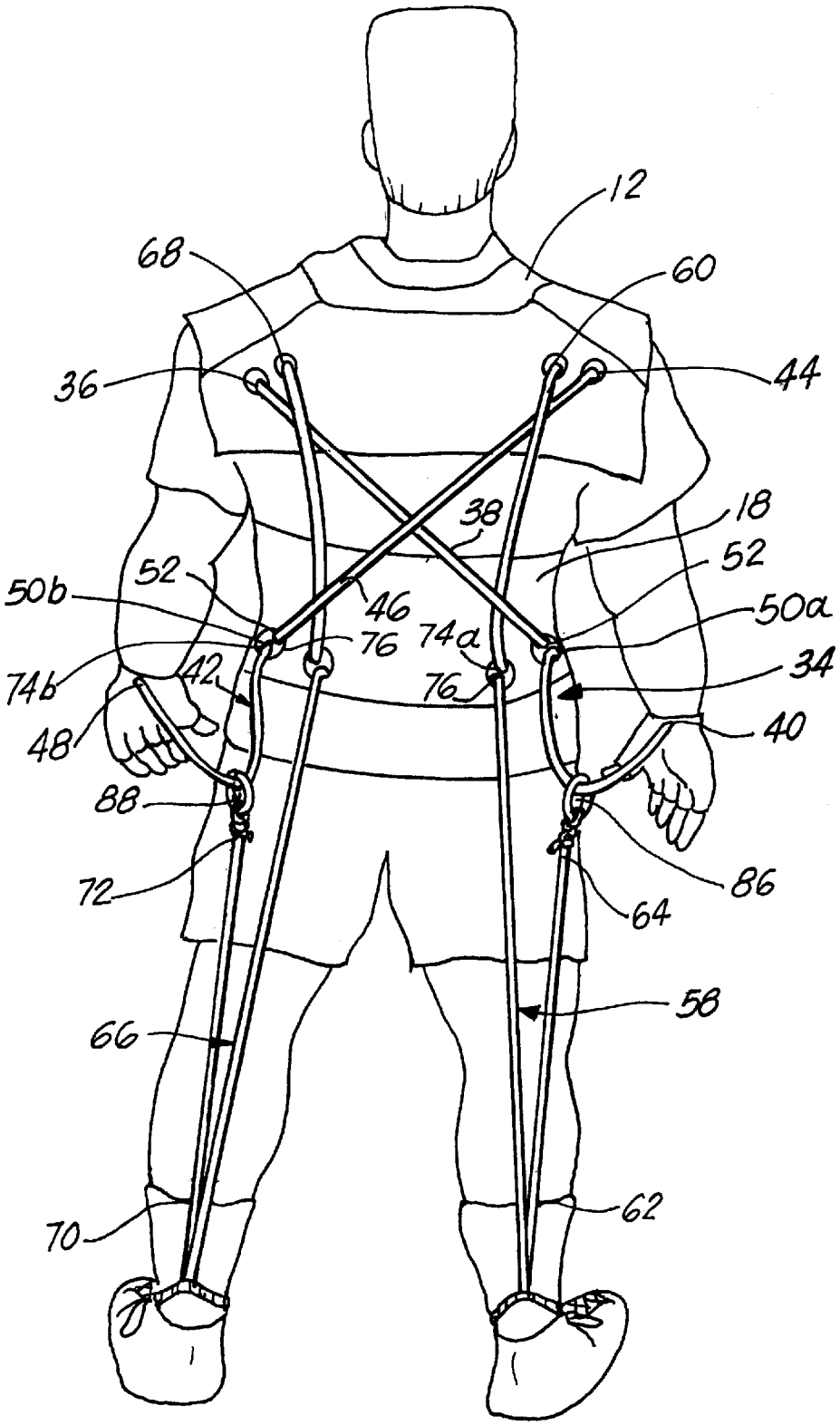
FIG. 2 is a rear perspective view of the athletic trainer of the present invention being worn by a user.
Figure 3:
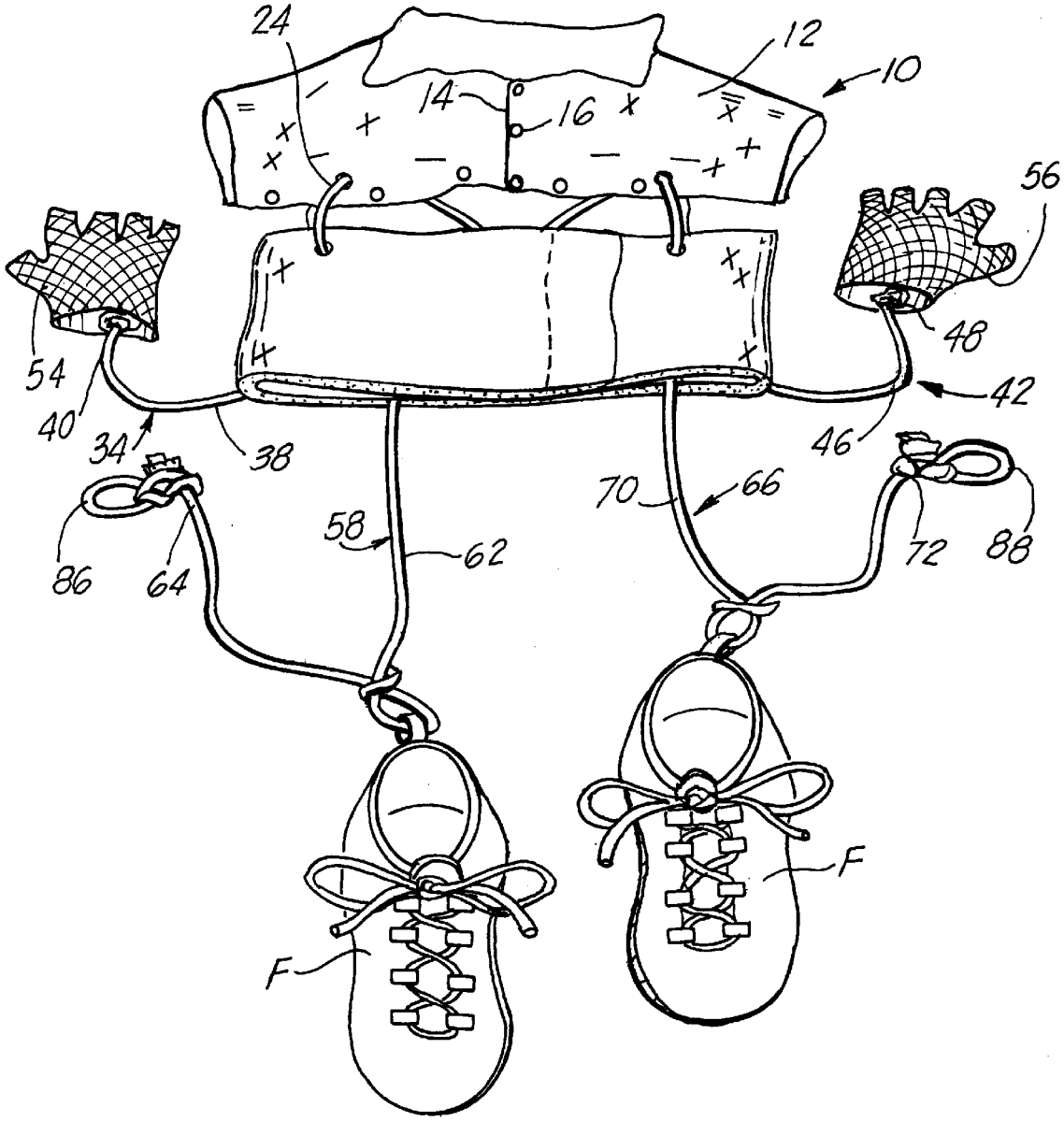
FIG. 3 is a front elevation view of the athletic trainer of the present invention.
Figure 4:
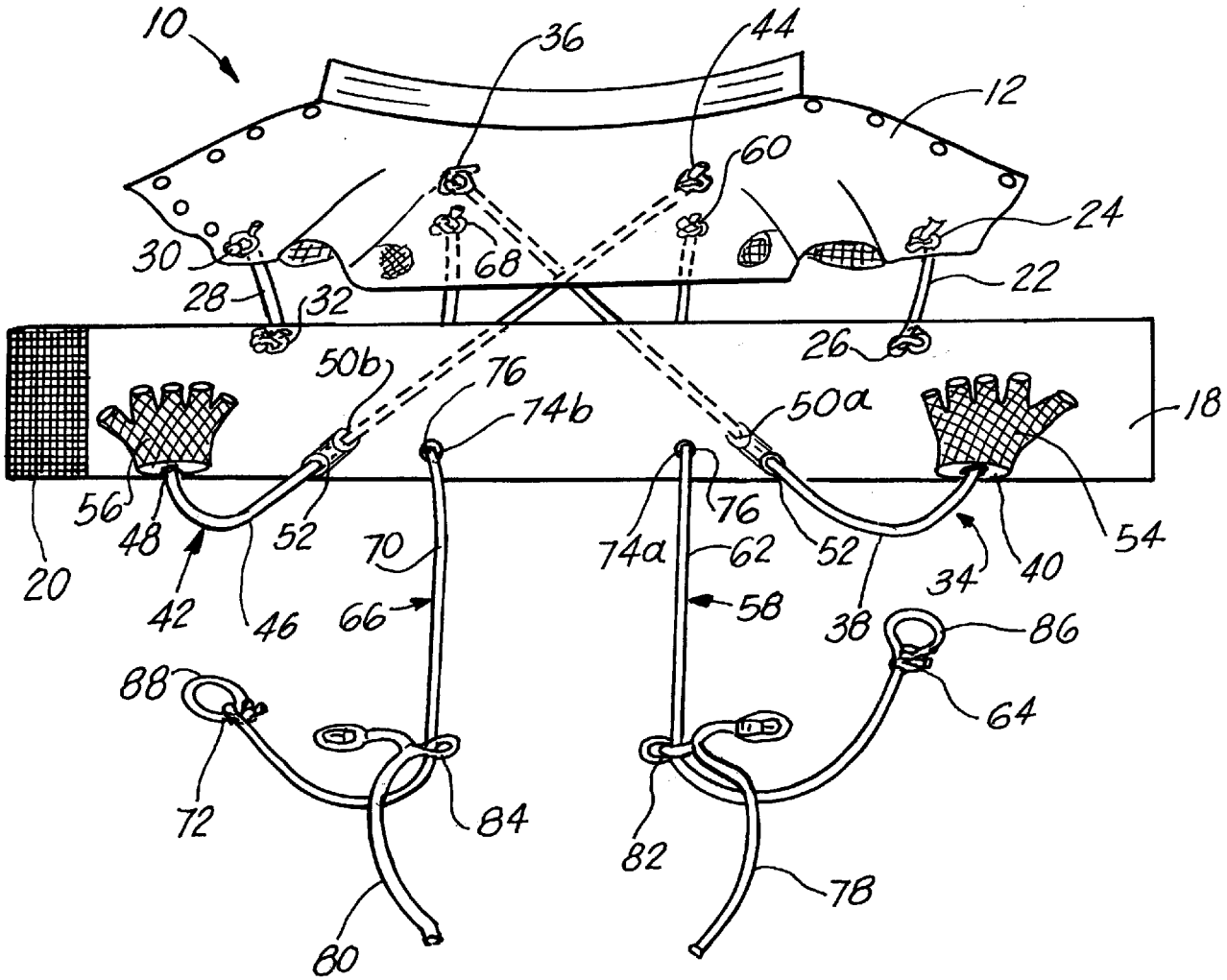
FIG. 4 is a rear elevation view of the athletic trainer of the present invention.

Referring now to the drawings, it is seen that the athletic trainer of the present invention, generally denoted by reference numeral 10, is comprised of a skirt 12 that is worn on the user's shoulders. The skirt 12 can be slipped over the user's head, or can have a opening 14 that can be closed by any standard means such as by the illustrated snaps 16, buttons, cooperating hook and loop material, etc. Ideally, the skirt 12 will be made from a relatively strong material such as thick cotton, polyester, or leather, and may have an absorbent layer (not illustrated) for absorbing the sweat from the user U. A wrap 18 is designed to be worn around the user's torso area. The wrap 18 is similar in design and construction to a typical weight lifting belt and has appropriate closure means such as the illustrated hook and loop material 20 to close and size the wrap 18 around the torso of the user U. The wrap 18 may also have a reinforced portion (not illustrated) to protect the user's back.

A first elastic cord 22 has a first end 24 attached to the skirt 12 and a second end 26 attached to the wrap 18 while a second elastic cord 28 has a third end 30 attached to the skirt 12 and a fourth end 32 attached to the wrap 18, attachment of the respective ends of each cord 22 and 28 accomplished in any desired fashion. A third elastic cord 34 has a fifth end 36 attached to the skirt 12, a first medial portion 38 coupled to the wrap 18, and a sixth end 40, while a fourth elastic cord 42 has a seventh end 44 attached to the skirt 12, a second medial portion 46 coupled to the wrap 18, and an eighth end 48. The first medial portion 38 of the third elastic cord 34 and the second medial portion 46 of the fourth elastic cord 42 can each be coupled to the wrap 18 in any appropriate manner such as by providing a ring (not illustrated) on the wrap 18 and passing the respective cord through the respective ring or by having at least one aperture 50*a* and 50*b* on the wrap 18 and passing the respective cord 34 and 42 through the respective at least aperture 50*a* and

50*b*. Grommets 52 can encompass each aperture 50*a* and 50*b* to prevent tearing of the wrap 18. A first glove 54 can be attached to the sixth end 40 of the third elastic cord 34 while a second glove 56 can be attach to the eight end 48 of the fourth elastic cord 42.

A fifth elastic cord 58 has a ninth end 60 attached to the skirt 12, a third medial portion 62 coupled to the wrap 18, and a tenth end 64, while a sixth elastic cord 66 has an eleventh end 68 attached to the skirt 12, a fourth medial portion 70 coupled to the wrap 18, and a twelfth end 72. The third medial portion 62 of the fifth elastic cord 58 and the fourth medial portion 70 of the sixth elastic cord 66 can each be coupled to the wrap 18 in any appropriate manner such as by providing a ring (not illustrated) on the wrap 18 and passing the respective cord through the respective ring or by having at least one aperture 74*a* and 74*b* on the wrap 18 and passing the respective cord 58 and 66 through the respective at least aperture 74*a* and 74*b*. Grommets 76 can encompass each aperture 74*a* and 74*b* to prevent tearing of the wrap 18. A first strap 78 can be attached to the tenth end 64 while a second strap 80 can be attach to the twelfth end 72. The first strap 78 and the second strap 80 are each attached to the footwear F of the user U. Attachment of the first strap 78 and the second strap 80 to the respective cord 58 and 66 can be accomplished in any appropriate fashion. For example, a first ring 82 can be provided and the fifth elastic cord 58 can pass through the first ring 82 with the first strap 78 attached to the first ring 82, while a second ring 84 can be provided and the sixth elastic cord 66 can pass through the second ring with the second strap 80 attached to the second ring 84. A first loop 86 is attached to the tenth end 64 of the fifth elastic cord 58 while a second loop 88 is attached to the twelfth end 72 of the sixth elastic cord 66. Each loop 86 and 88 can be a separate element attached to the respective elastic cord 58 and 66 or can be formed by looping the respective elastic cord 58 and 66 back onto itself and attaching thereto.

In order to use the athletic trainer 10 of the present invention, the user U dons the skirt 12 and closes it appropriately. The user U also dons the wrap 18 and closes it appropriately. The user U dons each glove 54 and 56 and attaches each strap 78 and 80 to the appropriate footwear F. Each loop 86 and 88 is either held in the appropriate hand of the user U or is attached to the respective glove 54 and 56 of the user. The user U is now free to exercise a desired body part or parts. As the athletic trainer 10 is secured to a large number of locations throughout the body, most muscle groups can be exercised.

While the invention has been particularly shown and described with reference to an embodiment thereof, it will be appreciated by those skilled in the art that various changes in form and detail may be made without departing from the spirit and scope of the invention.

I claim:

1. An athletic trainer comprising:

a skirt adapted to be worn on the user's shoulders;

a wrap adapted to be worn around the user's torso area;

a first elastic cord having a first end attached to the skirt, and a second end attached to the wrap;

a second elastic cord having a third end attached to the skirt, and a fourth end attached to the wrap;

a third elastic cord having a fifth end attached to the skirt, and a first medial portion coupled to the wrap, and a sixth end;

a fourth elastic cord having a seventh end attached to the skirt, and a second medial portion coupled to the wrap, and an eighth end;

a fifth elastic cord having a ninth end attached to the skirt, and a third medial portion coupled to the wrap, and a tenth end;

a sixth elastic cord having a eleventh end attached to the skirt, and a fourth medial portion coupled to the wrap, and a twelfth end;

a first glove attached to the sixth end;

a second glove attached to the eighth end;

a first strap attached to one foot of the user and to the tenth end;

a second strap attached to the other foot of the user and the twelfth end.

2. The athletic trainer as in claim 1 wherein the first strap is attached to the fifth elastic cord by a first ring and the second strap is attached to the sixth elastic cord by a second ring.

3. The athletic trainer as in claim 1 further comprising:

a first loop portion attached to the tenth end; and a second loop portion attached to the twelfth end.

4. The athletic trainer as in claim 1 further comprising a cooperating hook and loop portion attached to the wrap.

5. An athletic trainer comprising:

a skirt;

a wrap having at least one first aperture, at least one second aperture, a third aperture, and a fourth aperture;

a first elastic cord having a first end attached to the skirt, and a second end attached to the wrap;

a second elastic cord having a third end attached to the skirt, and a fourth end attached to the wrap;

a third elastic cord having a fifth end attached to the skirt, a first medial portion passing through each of the at least one first aperture, and a sixth end;

a fourth elastic cord having a seventh end attached to the skirt, a second medial portion passing through each of the at least one second aperture, and an eighth end;

a fifth elastic cord having a ninth end attached to the skirt, a third medial portion passing through the third aperture, and a tenth end; and a sixth elastic cord having a eleventh end attached to the skirt, a fourth medial portion passing through the fourth aperture, and a twelfth end.

6. The athletic trainer as in claim 5 further comprising:

a first glove attached to the sixth end; and a second glove attached to the eighth end.

7. The athletic trainer as in claim 5 further comprising:

a first strap attached to the fifth elastic cord; and a second strap attached to the sixth elastic cord.

8. The athletic trainer as in claim 7 wherein the first strap is attached to the fifth elastic cord by a first ring and the second strap is attached to the sixth elastic cord by a second ring.

9. The athletic trainer as in claim 5 further comprising:

a first loop portion attached to the tenth end; and a second loop portion attached to the twelfth end.

10. The athletic trainer as in claim 5 further comprising a cooperating hook and loop portion attached to the wrap.

11. The athletic trainer as in claim 5 further comprising:

at least one first grommet, each encompassing a respective one of the at least one first aperture;

at least one second grommet, each encompassing a respective one of the at least one second aperture;

a third grommet encompassing the third aperture; and a fourth grommet encompassing the fourth aperture.

* * * * *